US007198434B2

(12) United States Patent
Blum

(10) Patent No.: US 7,198,434 B2
(45) Date of Patent: Apr. 3, 2007

(54) FULL-DISPLACEMENT PRESSURE GROUTED PILE SYSTEM AND METHOD

(75) Inventor: Kenneth J. Blum, Shawnee, KS (US)

(73) Assignee: Berkel & Company Contractors, Inc., Bonner Springs, KS (US)

( * ) Notice: Subject to any disclaimer, the term of this patent is extended or adjusted under 35 U.S.C. 154(b) by 309 days.

(21) Appl. No.: 10/890,061

(22) Filed: Jul. 13, 2004

(65) Prior Publication Data

US 2006/0013656 A1 Jan. 19, 2006

(51) Int. Cl.
*E02D 5/56* (2006.01)

(52) U.S. Cl. ..... 405/241; 175/65; 175/323

(58) Field of Classification Search ..... 175/65, 175/325.3; 405/242, 241, 231, 232
See application file for complete search history.

(56) References Cited

U.S. PATENT DOCUMENTS

| | | | | |
|---|---|---|---|---|
| 1,139,529 | A | 5/1915 | Hughes | |
| 1,248,614 | A | 12/1917 | Chapman | |
| 1,322,540 | A | 11/1919 | Chapman | |
| 1,515,819 | A * | 11/1924 | Zublin | 175/392 |
| 3,255,592 | A | 6/1966 | Moor | |
| 3,282,055 | A | 11/1966 | Landau | |
| 3,926,267 | A | 12/1975 | Svirschevsky et al. | |
| 4,193,461 | A | 3/1980 | Lamberton et al. | |
| 4,230,191 | A | 10/1980 | Svieschevsky et al. | |
| 4,433,943 | A | 2/1984 | Pao Chen | |
| 4,504,173 | A | 3/1985 | Feklin | |
| 4,917,196 | A * | 4/1990 | Stiffler et al. | 175/385 |
| 4,966,498 | A | 10/1990 | Blum | |
| 5,064,360 | A | 11/1991 | Blum | |
| 5,073,080 | A | 12/1991 | Blum | |
| 5,242,027 | A | 9/1993 | Blum | |
| 5,427,191 | A * | 6/1995 | Rickards | 175/354 |
| 5,542,786 | A | 8/1996 | Blum | |
| 5,722,498 | A | 3/1998 | Van Impe et al. | |
| 6,033,152 | A | 3/2000 | Blum | |

(Continued)

FOREIGN PATENT DOCUMENTS

DE 196 51 586 C2 2/1999

(Continued)

OTHER PUBLICATIONS

N.J. Wharmby, The Development and Testing of the ScrewSol Rotary Displacement Pile, Abstract, Bachy Soletanche Ltd., Henderson House, Langley Place, Higgins Lane, Burscough, Lancashire, L40 8JB England.

*Primary Examiner*—David Bagnell
*Assistant Examiner*—Brad Harcourt
(74) *Attorney, Agent, or Firm*—Mark E. Brown

(57) ABSTRACT

An auger bit is provided for a foundation pile system including a drilling rig adapted for mounting and rotating a grout pipe connected to the auger bit to form an auger. The auger bit includes a stem with lower and upper sections, which taper towards a transition whereat the stem has a maximum diameter. A pile foundation forming method includes the steps of providing a drilling rig, forming an auger with a grout pipe coupled to an auger bit, rotating the auger wit the rig, forming a borehole with laterally displaced soil, pumping pressurized grout through the auger and into the borehole, placing a reinforcing cage in the wet grout and curing same.

20 Claims, 5 Drawing Sheets

U.S. PATENT DOCUMENTS 6,116,819 A * 9/2000 England ..... 405/241
6,238,142 B1 5/2001 Harsch
6,283,231 B1 * 9/2001 Coelus ..... 175/323
6,311,788 B1 11/2001 Weixler
6,502,649 B1 * 1/2003 Havel ..... 175/18
6,540,443 B2 4/2003 Kato et al.
6,672,015 B2 1/2004 Cognon

FOREIGN PATENT DOCUMENTS

EP 0 634 528 A2 7/1994
WO WO97/05334 A1 2/1997

* cited by examiner

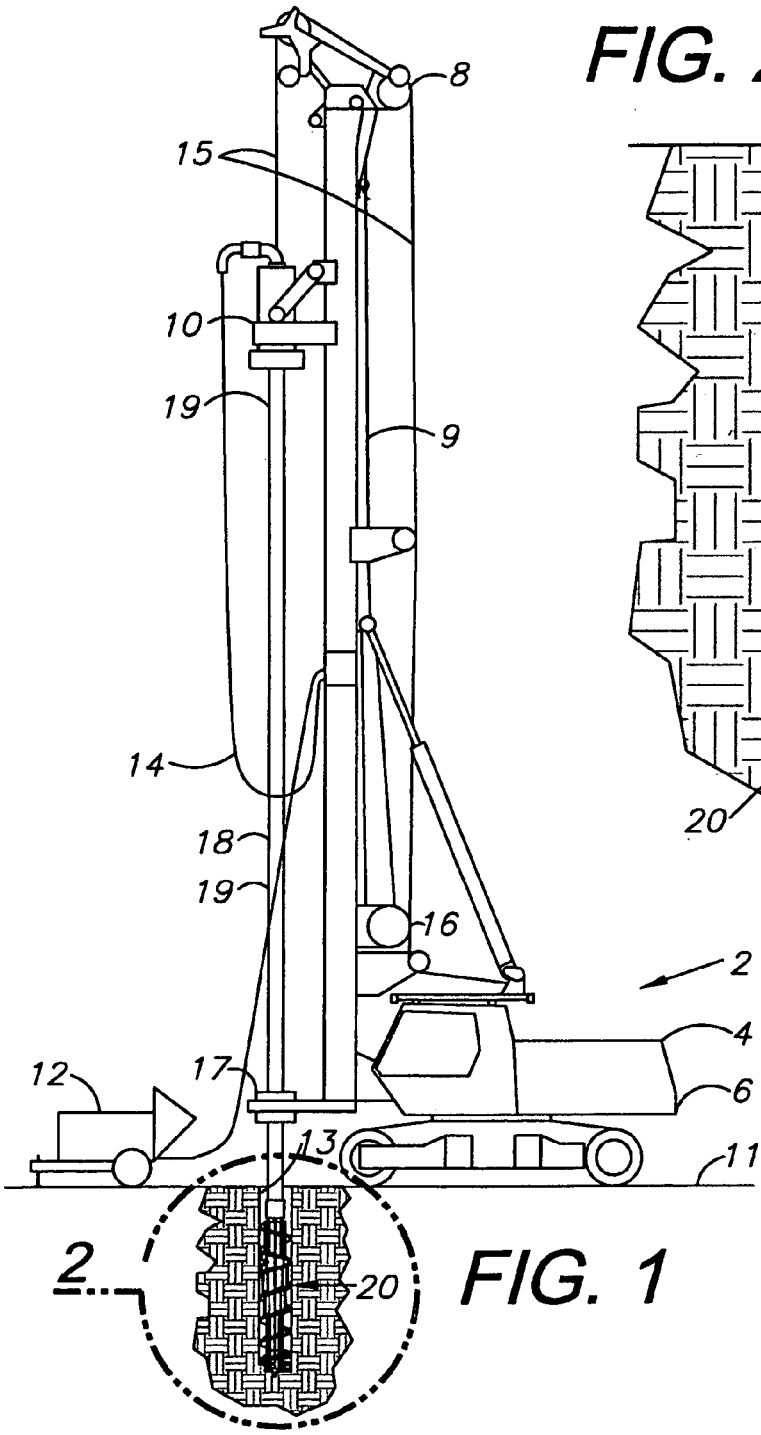
FIG. 1
FIG. 2
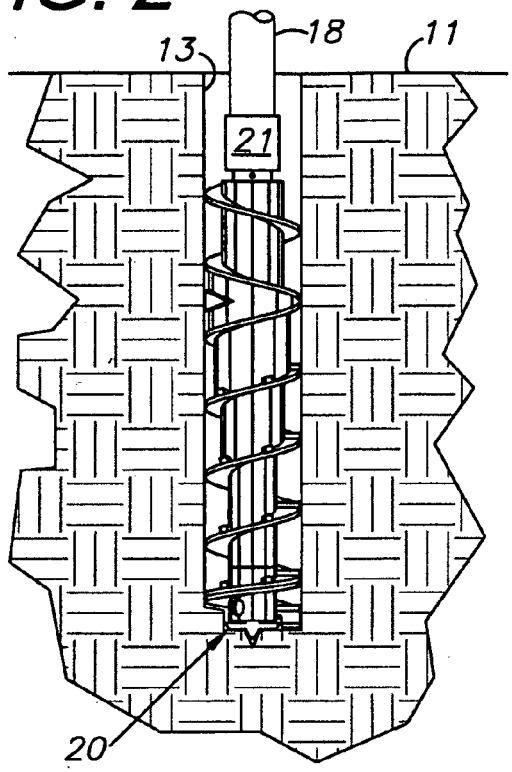

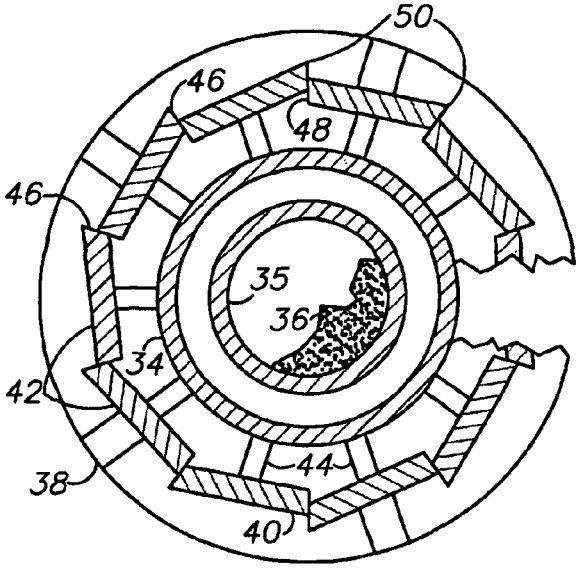
FIG. 4
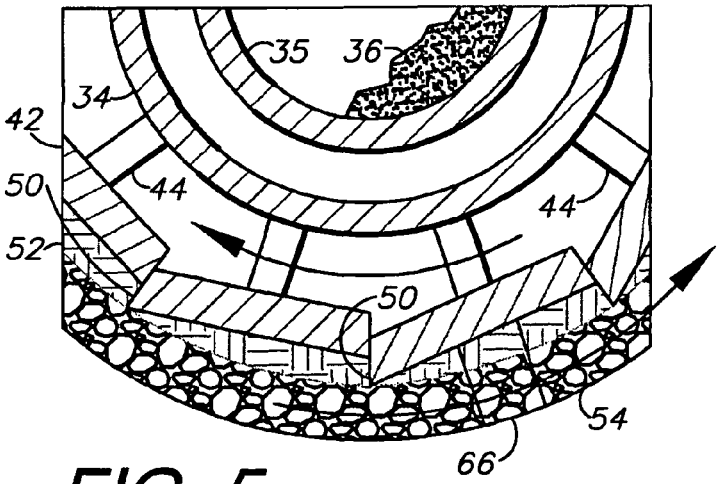
FIG. 5
FIG. 3
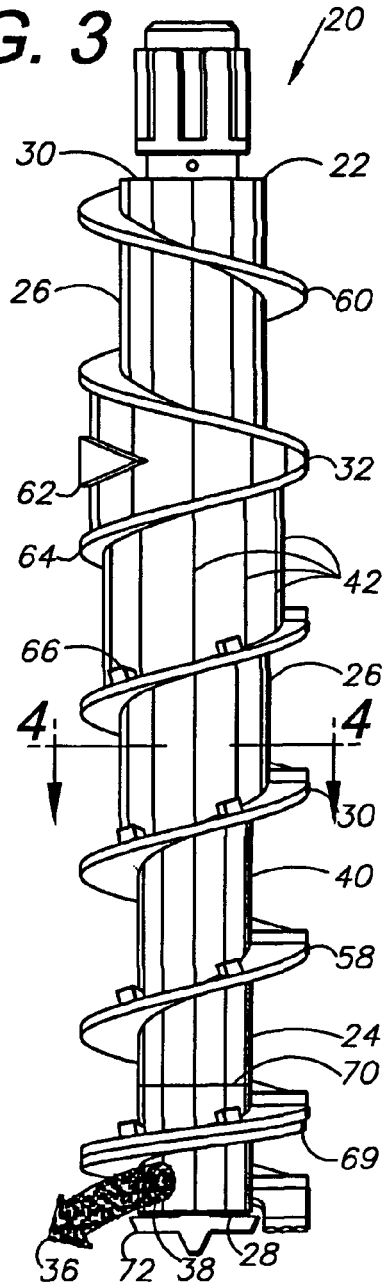

FULL-DISPLACEMENT PRESSURE GROUTED PILE SYSTEM AND METHOD

BACKGROUND OF THE INVENTION

1. Field of the Invention

The present invention relates generally to pressure-grouted foundation pile forming equipment, and in particular to an auger bit adapted for substantially fully displacing soil while drilling a borehole, and a corresponding pile forming method using same.

2. Description of the Related Art

In the field of foundation construction, pile-type foundation systems are commonly used to support a wide variety of structures. Typical structural applications include commercial buildings, institutional buildings, industrial facilities, power plants, transportation and other structures involving relatively heavy static loads. Moreover, dynamic loads associated with operating equipment can be accommodated by pile-type foundation systems.

The piles comprising such foundation systems can be formed with poured-in-place concrete, which is generally poured into predrilled boreholes around steel reinforcing bar cages, which have been preset in the boreholes. Auger pressure grouting ("APG") represents another type of pile forming technique wherein grout (generally comprising cement, fine aggregate, such as sand, and appropriate admixtures) is injected under pressure through the auger bit into the borehole, for example, during the extraction of the auger bit. APG foundations generally offer advantages of relatively high bearing capacities and relatively fast, cost-effective construction. Moreover, significant material savings can often be achieved, as compared to comparable poured-in-place pile foundation systems.

Auger pressure grouting with displacement ("APGD") methods can offer further advantages, particularly with respect to the elimination of excessive spoilage extracted from the boreholes, which presents a disposal problem. Spoilage disposal can be particularly expensive and problematical when hazardous wastes are encountered in the subsurface soil being drilled, for example in environmental remediation projects and on project sites containing buried hazardous wastes. An APGD pile forming apparatus is shown in U.S. Pat. No. 6,033,152. The auger bit shown therein includes a lower section with constant-diameter, right-hand flighting on a downwardly-tapered core and an upper section with reverse (left-hand) flighting on an upwardly-tapered core. The tapered configuration of the lower section tends to displace and compact the soil laterally. The reverse flighting of the upper section pushes the spoilage brought up by the lower section back downwardly and outwardly for compaction.

Several benefits can be achieved with such displacement. The lateral displacement tends to "improve" the soil. Specifically, the borehole is thus lined with compacted soil, which tends to contain the grout and prevent its dispersal into loose, uncompacted surrounding soil. Another benefit relates to minimizing the quantity of spoilage exiting the borehole at grade. As compared to conventional, full-flight augers, displacement-type auger bits tend to displace soil capable of displacement. Displacement also avoids the extraction of soft, sloppy, water-laden soil. Another disadvantage associated with conventional, full-flight augers relates to over-excavation whereby excessive quantities of softer soil are extracted from certain portions of boreholes. The resulting over-excavated boreholes often have hour-glass-shaped configurations with enlarged portions, which tend to require excessive quantities of grout or concrete, as compared to cylindrical, straight-walled boreholes. Such extra material can be relatively expensive, particularly when multiple and relatively deep boreholes are affected.

Lateral soil displacement can be accomplished with auger bits having tapered stems, which tend to force the displaced soil laterally outwardly. An example is shown in U.S. Pat. No. 6,033,152, which discloses a "full" displacement auger bit with a tapered stem and bidirectional flighting. The stem expands upwardly from a minimum diameter at its lower end to a maximum diameter at a transition section where the flighting reverses, and contracts back to a reduced diameter at an upper end of the auger bit. The flighting has a relatively constant diameter, which is approximately equal to the maximum diameter of the stem at the transition section whereby substantially "full" displacement occurs at the transition section. The fully-expanded stem and the bidirectional flighting of this auger bit cooperate to force substantially all of the displaced soil to the transition section of the bit, which "displaces" and compacts it laterally into the borehole periphery. The borehole periphery is thereby "improved", with greater grout-retaining capacity.

Pile forming operations can extend to considerable depths, as required by project structural design criteria and depending upon the load-bearing capacity of the soil conditions encountered at different depths. For example, APGD piles can extend 50 feet or more into the earth. Pile diameters of two feet or more are relatively common. The various combinations of soil, rock and buried concrete (e.g., from previous projects) encountered in such borings tend to affect the materials and configurations of different cutting tips mounted on the augers. For example, soils with high rock content require bits with special cutting teeth and hardened (e.g., heat-treated) steel construction. Soils comprising primarily clay and/or sand, on the other hand, can be drilled with bits having other tip constructions and configurations.

Wear-resistance is a relatively important aspect of APGD bit design. Costs associated with bit wear and replacement tend to be relatively high. Therefore, minimizing wear and the attendant costs of same are important criteria. The present invention addresses these design criteria. Heretofore there has not been available a full-displacement APGD system and method with the advantages and features of the present invention.

SUMMARY OF THE INVENTION

In the practice of an aspect of the present invention, a full displacement system is provided for forming an auger pressure grouted displacement (APGD) foundation pile. The system includes a rig adapted for hoisting and rotating an auger for drilling a subsurface borehole. The auger includes an auger bit with bidirectional flighting and a tapered stem, which cooperate to laterally displace and compact soil on the borehole periphery. The auger bit includes anti-wear protrusions, comprising stepped edges of the stem plates and blocks extending transversely across the flighting upper faces. The protrusions trap soil in protective positions on the stem and flighting for protecting same from wear. Another anti-wear feature comprises a double layer of flighting at the auger bit lower end. In the practice of the method of the present invention, the auger is hoisted and rotated by the rig, which is also adapted for exerting a downward "crowding" force for boring. Upon reaching a desired depth, as determined by soil bearing conditions, the auger is extracted simultaneously with pumping grouting material therethrough and into the borehole. The rig can optionally be utilized for placing a reinforcing cage in the grout material for curing in-place to provide a reinforced pile.

BRIEF DESCRIPTION OF THE DRAWINGS

FIG. 1 shows an APGD system for constructing subsurface foundation piles embodying the present invention.

FIG. 2 is an enlarged, fragmentary, cross-sectional view of a full-displacement type auger bit boring the upper part of a borehole.

FIG. 3 is a side elevational view of the full displacement auger bit.

FIG. 4 is a horizontal, cross-sectional view of the auger bit, taken generally along line 4—4 in FIG. 3.

FIG. 5 is an enlarged, fragmentary, horizontal, cross-sectional view of the auger bit, showing soil compacted on and deflected by same.

DETAILED DESCRIPTION OF THE PREFERRED EMBODIMENTS

I. Introduction and Environment

Figure 6:
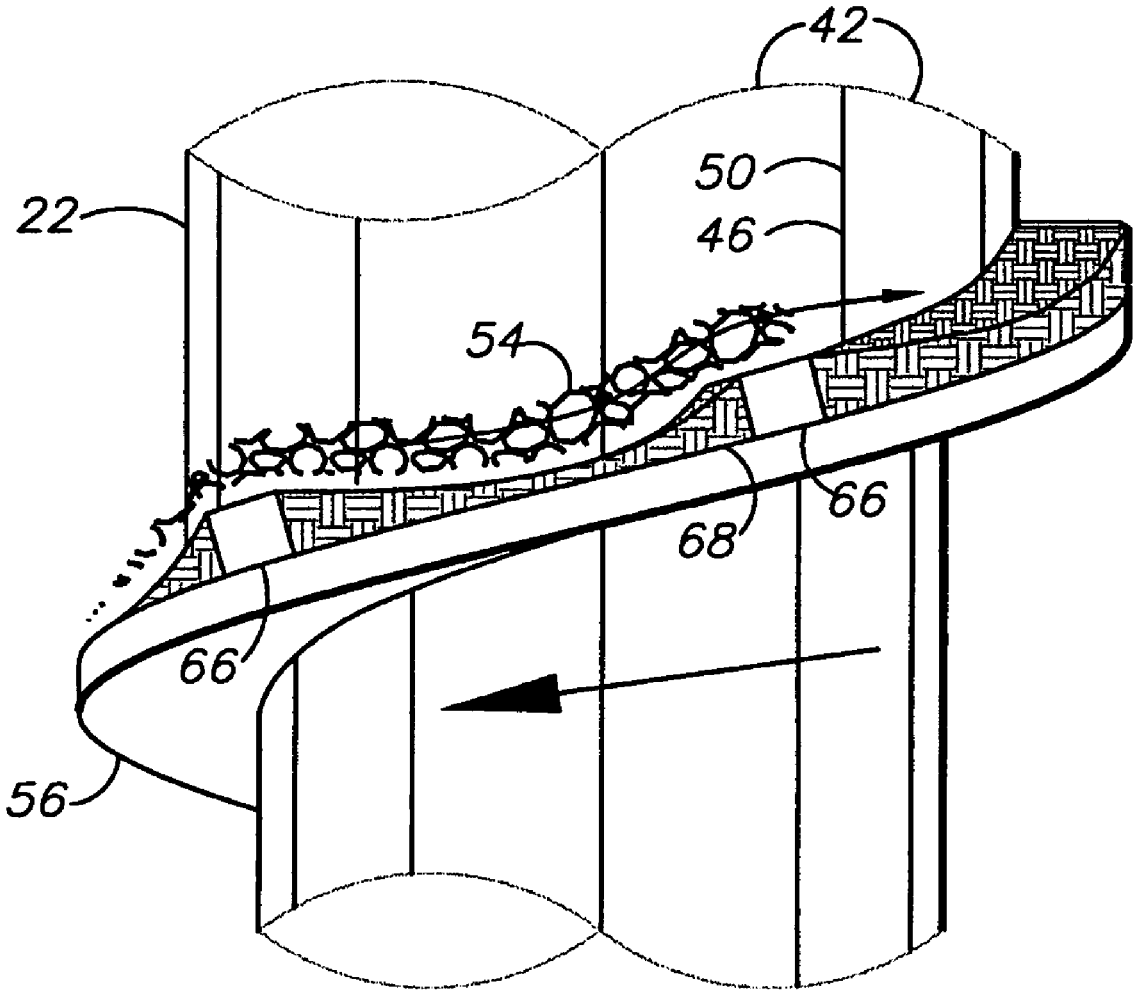
FIG. 6 is an enlarged, fragmentary, side elevational view of the auger bit, showing soil compacted on and passing along the flighting of same.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, up, down, front, back, right and left refer to the invention as oriented in the view being referred to. The words "inwardly" and "outwardly" refer to directions toward and away from, respectively, the geometric center of the embodiment being described and designated parts thereof. Said terminology will include the words specifically mentioned, derivatives thereof and words of similar meaning.

II. Preferred Embodiment APGD System 2

Referring to the drawings in more detail, the reference numeral 2 generally designates a pile-forming system embodying the present invention and including a rig 4 with a tracked transport vehicle and power source 6 mounting a mast 8 with a generally vertical, drilling position (FIG. 1) and a generally horizontal transport position (not shown). The mast 8 includes a support column 9, which slidably mounts a rotary drive 10 adapted for raising and lowering by a cable network 15. A grout pump 12 is provided for pumping grout through a grout supply hose 14 to the rotary drive 10. An auger 19 includes a grout pipe 18 drivingly connected to the rotary drive 10 and rotating in a lower guide 17.

In performing a boring operation, the vehicle 6 traverses a job site ground surface 11 to locate the auger 19 over the desired location of a borehole 13. The rig 4 can include manual or automatic fine adjustment controls for relatively precisely positioning the auger 19 and plumbing the mast 8. The auger 19 includes an auger bit 20, which is mounted on the lower end of the grout pipe 18 by a splined coupling 21 and is adapted for boring the borehole 13 when rotated by the rotary drive 10. The auger 19 is urged downwardly (i.e. "crowded") by a crowd winch 16 operating through the cable network 15. Grout is pumped from the grout pump 12 through a swivel connection in the rotary drive 10, through the grout pipe 18 and into the auger bit 20 for discharge from the lower end thereof during extraction of the auger bit 20 whereby the borehole 13 is filled with cementous grout below the extracting auger bit 20.

The system 2 and the method described thus far are generally similar to known prior art systems. For example, U.S. Pat. No. 6,033,152 for Pile Forming Apparatus shows such a system and is incorporated herein by reference.

III. Auger Bit 20

The auger bit 20 includes a stem 22 with lower and upper sections 24, 26 terminating at stem lower and upper ends 28, 30 respectively. The stem lower section 24 is tapered with a downwardly-converging configuration and the stem upper section 26 is oppositely tapered with an upwardly-converging configuration. The maximum diameter of the stem 22 occurs at a transition 32 whereat the stem diameter is approximately equal to the overall diameter of the auger bit 20. The bit 20 is thus a "full" displacement type. "Partial" displacement augers, on the other hand, have stem diameters that are less than their overall flighting diameters.

As shown in FIG. 4, the stem 22 includes an outer pipe core 34 and an inner pipe core 35, which are coaxial with a rotational axis of the auger 11. The inner pipe core 35 communicates with the grout pipe 18 for pumping grout 36 through the auger 20 for discharge into the borehole 13 via a discharge opening 38 located in proximity to the stem lower end 28. The grout-carrying, inner pipe core 35 extends substantially full-length with respect to the bit 20. The outer pipe core 34 is located within the expanded-diameter, upper, displacement portion of the stem 22 and terminates short of the constant-diameter, lower portion. The stem 22 also includes a generally helical, outer shell 40 comprising multiple, juxtaposed plates 42 mounted on the pipe core 34 by spacers 44. Each plate 42 has leading and trailing edges 46, 48 respectively, which are staggered as shown in FIGS. 4 and 5 whereby protruding portions of the leading edges 46 form respective teeth 50. The leading edges 46 can be angle-cut to form acute angles defining the teeth 50. The protrusions defined by the teeth 50 trap a stem-protecting soil layer 52, which is packed tightly against the outside surface of the stem shell 40 and protects same from wear associated with displaced spoilage 54 moving counter to the auger rotating direction (FIG. 5).

The auger bit 20 also includes flighting 56 including a lower, right-hand flighting section 58 and an upper, left-hand flighting section 60 associated with the stem lower and upper sections 24, 26 respectively. The flighting sections 58, 60 converge at the transition 32 to form a V-shaped flighting point 62. At the transition 32 the stem 22 diameter substantially equals the flighting 56 diameter whereby substantially all of the displaced soil material is displaced laterally and compacted into the sides of the borehole 13, i.e. "full" displacement. Conversely, the maximum exposure of the flighting 56 occurs in proximity to the stem lower and upper ends 28, 30.

The flighting 56 is equipped with anti-wear protrusions comprising blocks 66 mounted on the upper face of the lower flighting section 58 and generally extending radially outwardly from the stem outer shell 40 to a flighting edge 64. A suitable number of blocks 66 are located at appropriate intervals along the lower flighting section 58 and form protective packed-soil flighting shields 68, which reduce abrasive contact between displaced spoilage 54 and the upper surfaces of the flighting lower section 58, as shown in FIG. 6. The auger bit 20 includes yet another anti-wear protrusion consisting of an extra flighting layer 69 mounted (e.g. welded) to the underside of the lowermost portion of the lower flighting section 58. The extra flighting layer 69 can significantly prolong the useful service life of the auger bit 20, which might otherwise require earlier replacement due to the severe wear conditions that this lowermost portion of the flighting 56 are often subjected to during drilling operations.

Figure 9:
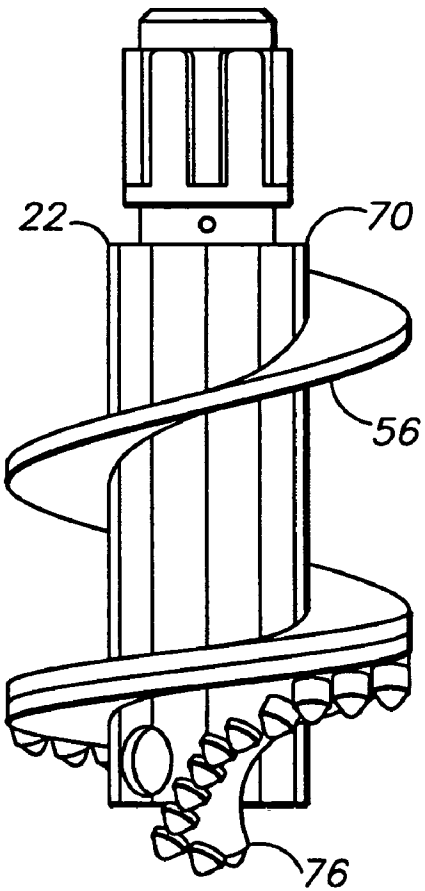
FIG. 9 is a side elevational view of a third bit tip and cutting tool, particularly configured for rock, concrete and similar soil conditions.
Figure 8:
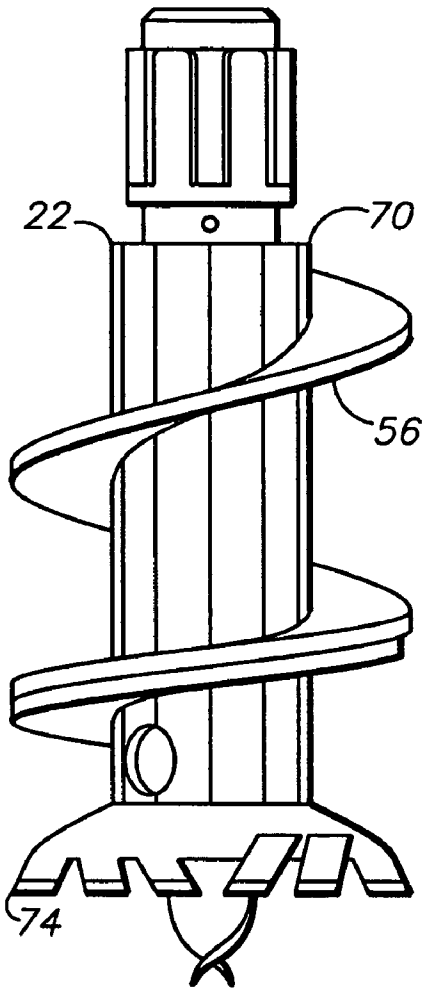
FIG. 8 is a side elevational view of a second bit tip and cutting tool, particularly configured for loam and similar soils.
Figure 7:
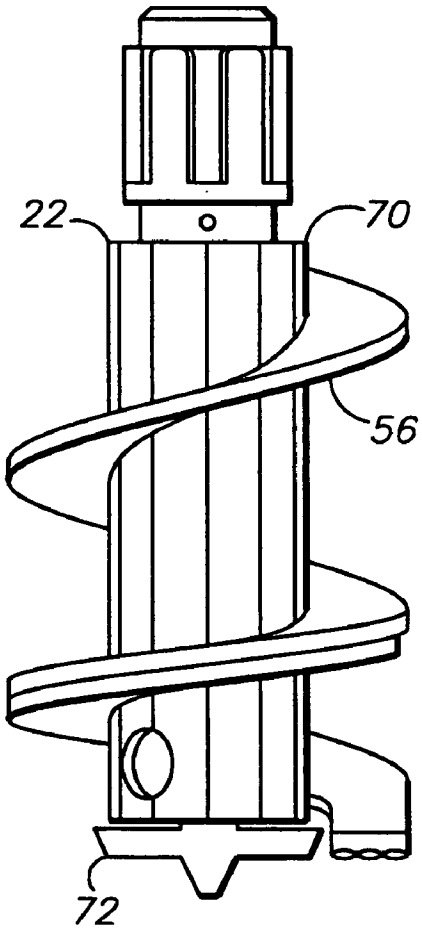
FIG. 7 is a side elevational view of a first bit tip and cutting tool, particularly configured for medium to hard clay, weathered shale and similar soil conditions.
Figure 10:
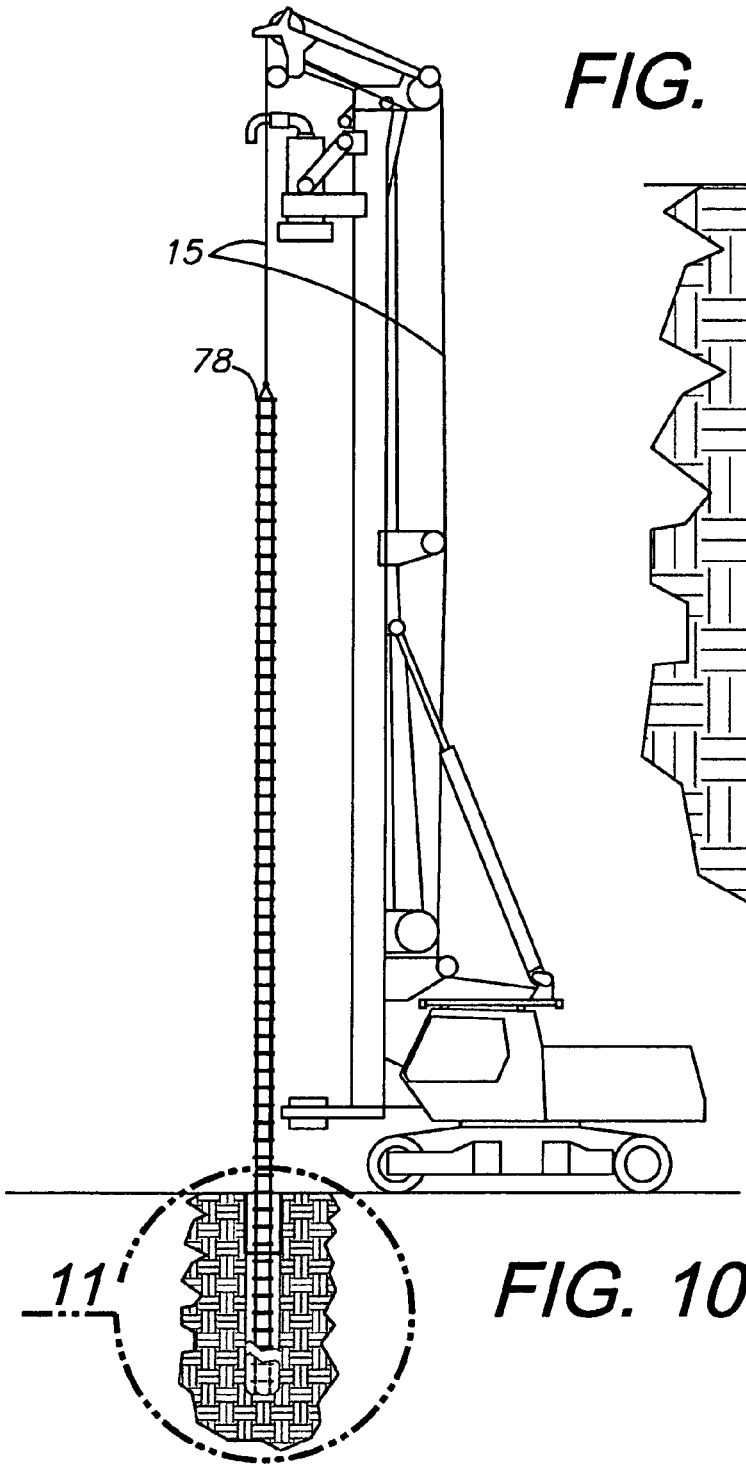
FIG. 10 is a side elevational view of the system, shown installing a reinforcing cage in the borehole.
Figure 11:
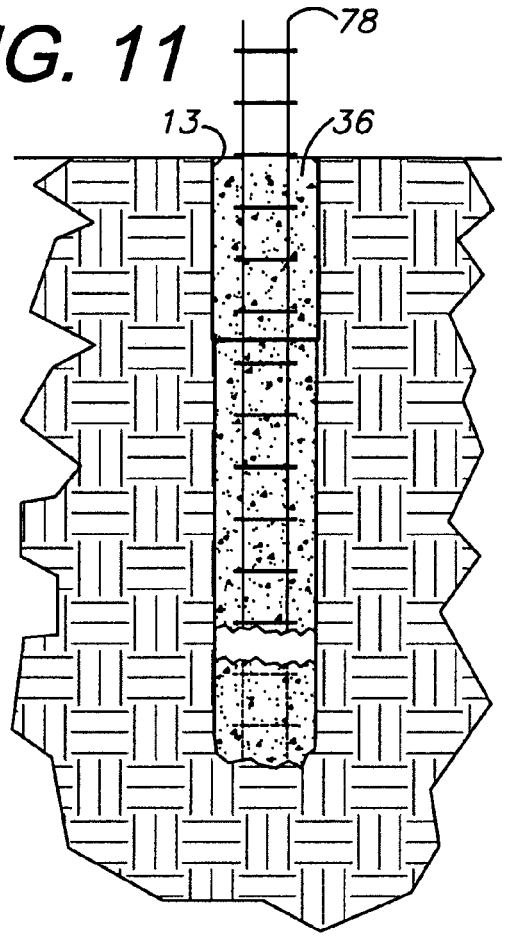
FIG. 11 in an enlarged, fragmentary, side elevational view of the completed foundation pile, showing the reinforcing cage in place.

The auger bit 20 can include a removable and replaceable tip 70 adjacent to and including the stem lower end 28. The tip 70 terminates at a cutting tool 72, which can be configured for the particular soil conditions encountered at a job site. Exemplary cutting tool configurations which are known in the prior art are shown in FIGS. 7–9. FIG. 7 shows the cutting tool 72, which is particularly configured for medium to hard clay, weathered shale and similar soil conditions. FIG. 8 shows a cutting tool 74, which is particularly configured for loam and similar soils. FIG. 9 shows a cutting tool 76, which is particularly configured for rock, concrete and similar soil conditions. Various other tips and cutting tools can be utilized with the auger bit 20 of the present invention.

IV. Foundation Pile Forming Method

In the practice of the method of the present invention, the transport vehicle 6 is transported to a job site and the mast 8 is raised. The rotary drive 10 can be fully raised to commence a drilling procedure. Kelly bar extensions (not shown) are known in the prior art and provide additional boring depth capability by extending the auger 19 above the top of the mast 8. The rig 4 can be manually and/or automatically adjusted for relatively precise positioning of the borehole and for plumbing the mast 8. The rotary drive 10 rotates the auger 19 clockwise for the bit flighting configuration shown, i.e. right-hand through the flighting lower section 58. The weight of the auger 19 can be augmented by the weight of the rig 4 exerted through the crowd winch 16, which the operator can control in order to maintain a relatively constant downward pressure on the auger 19. The cutting tool 72, 74 or 76 breaks through the subsurface soil, rock, etc. and the right-hand lower section flighting 58 advances the auger 19, while conveying spoilage upwardly in a helical path defined by the lower section flighting 58. The upwardly-expanding diameter of the stem lower section 24, which is associated with its tapered configuration, tends to force the displaced spoilage outwardly, compacting same with the borehole 13 periphery.

The left-hand upper flighting section 60 pushes displaced material downwardly for lateral displacement and compaction adjacent to the full-displacement, auger bit transition 32. Such displacement and compaction provides several benefits. Little or no spoilage is extracted onto the ground surface 11, thus eliminating or reducing expenses and problems associated with spoilage disposal. Moreover, the periphery of the borehole 13 is compacted and stabilized, thus facilitating the pile formation by effectively retaining the wet grout. Without such stabilization, considerable volumes of grout could flow laterally into the adjacent soil, particularly in loose and sandy soil conditions and in over-excavated boreholes.

After reaching the desired depth, the auger 19 is extracted using the cable network 15. Rotation in the same direction is maintained through the downward insertion stroke and through the upward extraction stroke, whereby soil displacement can occur throughout both strokes. Simultaneously with extracting the auger 19, cementous material, such as grout 36, is discharged through the discharge opening 38. The weight of the column of grout 36 in the auger 19 tends to force the grout 36 into the borehole 13 under considerable pressure, which tends to minimize voids and air pockets.

After the borehole 13 is substantially filled with grout 36, the cable network 15 can be used to hoist a suitable reinforcing cage 78 on the mast 8. The reinforcing cage 78 can then be lowered into the wet grout 36. Suitable guides (not shown) can be provided for properly spacing the reinforcing cage 78 inwardly from the borehole 13 periphery whereby the reinforcing cage 78 is substantially centered therein. The reinforcing cage 78 can be suspended in the wet grout 36 by a suitable suspension device attached to the upper end of the reinforcing cage 78.

It is to be understood that the invention can be embodied in various forms, and is not to be limited to the examples discussed above. Other components and configurations can be utilized in the practice of the present invention.

Having thus described the invention, what is claimed as new and desired to be secured by Letters Patent is:

1. A displacement-type auger bit for drilling a borehole, which bit comprises:

a stem with lower and upper sections and a longitudinally-extending, rotational axis;

said lower and upper sections terminating at lower and upper stem ends respectively;

a cutting tool mounted on said lower stem end and adapted for cutting through a subsurface material in connection with drilling a borehole;

said stem lower section having a downwardly-tapered configuration;

said stem upper section having an upwardly-tapered configuration;

a coupling mounted on said stem upper end and adapted for coupling to a grout pipe;

flighting including a flighting tower section mounted on said stem lower section and generally helical in a first direction and a fighting upper section mounted on said stem upper section and generally helical in the opposite direction;

a soil path generally defined by said stem and said flighting; and anti-wear protrusions comprising multiple longitudinally-extending teeth formed along said stem and extending between respective turns of said flighting and adapted for trapping soil on said stem.

2. The auger bit according to claim 1 wherein said stem includes:

a hollow pipe core with a lower end located in proximity to said bit lower end and including a grout discharge opening and an upper and located in proximity to said bit upper end, said hollow pipe core being adapted for receiving grout at its upper end from said grout pipe through said coupling;

multiple spacers mounted an and extending radially outwardly from said core;

multiple plates mounted on said spacers and extending between respective flighting turns, each said plate having a leading edge protruding to form a respective tooth and a trailing edge abutting an adjacent plate leading edge; and said stem including an outer wear surface formed by said plates and having a sawtooth-shaped, cross-sectional configuration.

3. The auger bit according to claim 2, which includes:

each said stem plate lending and trailing edges forming respective acute angles at said outer surface of said stem; and said respective abutting plate edges being offset with respect to each other to form respective teeth.

4. The auger bit according to claim 3 wherein each said flighting block has a generally rectangular cross-sectional configuration with a leading edge adapted for forming an anti-wear soil shield on a section of flighting in front of said block and a trailing edge adapted for forming an anti-wear soil shield on a section of flighting behind said block.

5. The anger bit according to claim 3, which includes:

said flighting having lower and upper faces and an outer edge; and multiple said flighting blocks extending radially from said stem to said flighting outer edge in spaced relation along said flighting upper face.

6. The auger bit according to claim 1 wherein said anti-wear protrusion comprises a flighting block extending radially across said flighting and adapted for trapping soil on a respective face of said flighting.

7. The auger bit according to claim 1, which includes:

said flighting having lower and upper faces and an outer edge;

said anti-wear protrusion comprising an anti-wear flighting section mounted on said fighting lower face in proximity to said stem lower end and generally covering said flighting through at least a portion of a turn thereof.

8. The auger bit according to claim 1, which includes:

a main body subassembly with said stem upper section and a portion of said stem lower section;

a tip subassembly with a portion of said stem lower section, said grout discharge opening and said cutting tool; and said tip subassembly being joined to said main body subassembly at a connection whereat respective portions of said stem lower section and said flighting lower section align.

9. The auger bit according to claim 8, which includes:

said cutting tool including a cast guide and a reamer extension; and said cutting tool being adapted for cutting medium-to-hard clay and weathered shale.

10. The auger bit according to claim 8, which includes:

said cutting tool including a fishtail pilot and teeth; and said cutting tool being adapted for cutting loam and similar soils.

11. The auger bit according to claim to 8, which includes:

said cutting tool including a bullet tooth pilot and progressive bullet teeth; and said cutting tool being adapted for cutting rock and concrete.

12. The auger bit according to claim 8 wherein said discharge opening is open at said stem outer wear surface in proximity to said stem lower end.

13. The auger bit according to claim 1, which includes:

said stem upper and lower sections being connected at a transition;

said flighting having substantially the same diameter as said stem at said transition; and a V-shaped flighting point at an intersection of said lower and upper section flighting.

14. A displacement-type auger bit for drilling a borehole with a drilling rig and including a grout pipe adapted for rotation and for mounting said auger bit to form an auger, which auger bit comprises:

a stem with lower and upper sections and a longitudinally-extending, rotational axis;

said lower and upper sections terminating at lower and upper stem ends respectively;

a first anti-wear feature comprising multiple, longitudinally-extending teeth formed along said stem and extending between respective turns of said flighting and adapted for trapping soil on said stem;

a hollow pipe core with a lower end located in proximity to said stem lower end and including a grout discharge opening and an upper end located in proximity to said bit upper end, said hollow pipe core including coaxial inner and outer pipe cores, said inner pipe core being positioned within said outer pipe core and adapted for receiving grout at said pipe core upper end from said grout pipe through said coupling;

multiple spacers mounted on and extending radially outwardly from said outer pipe core;

multiple plates mounted on said spacers and extending between respective flighting turns, each said plate having a leading edge protruding to form a respective tooth and a trailing edge abutting an adjacent plate leading edge; and said stem including an outer wear surface formed by said plates and having a sawtooth-shaped, cross-sectional configuration each said stem plate leading and trailing edges forming respective acute angles at said outer surface of said stem; and said respective abutting plate edges being offset with respect to each other to form respective teeth;

said flighting having lower and upper faces and an outer edge;

a second anti-wear feature comprising multiple flighting blocks extending radially from said stem to said flighting outer edge in spaced relation along said flighting upper face and adapted for trapping soil on a respective face of said flighting;

each said flighting block having a generally rectangular cross-sectional configuration with a leading edge adapted for forming an anti-wear soil shield on a section of flighting in front of said block and a trailing edge adapted for forming an anti-wear soil shield on a section of flighting behind said block;

a third anti-wear feature comprising an anti-wear flighting section mounted on said flighting lower face in proximity to said stem lower end and generally covering said flighting through at least a portion of a turn thereof;

a main body subassembly with said stem upper section and a portion of said stem lower section;

a tip subassembly with a portion of said stem lower section, said grout discharge opening and said cutting tool; and said tip subassembly being joined to said main body subassembly at a connection whereat respective portions of said stem lower section and said flighting lower section align;

a cutting tool mounted on said lower stem end and adapted for cutting through a subsurface material in connection with drilling a borehole;

said stem lower section having a downwardly-tapered configuration;

said stem upper section having an upwardly-tapered configuration;

a coupling mounted on said stem upper end and adapted for coupling to a grout pipe;

flighting including a flighting lower section mounted on said stem lower section and generally helical in a first direction and a flighting upper section mounted on said stem upper section and generally helical in the opposite direction;

a soil path generally defined by said stem and said flighting; and said anti-wear features being adapted for spacing soil from portions of said stem or flighting.

15. A method of constructing a subsurface, cementous foundation pile, which comprises steps of:

providing an auger drilling rig including a mast and a hoisting cable on said mast;

rotatably mounting on the mast an auger including an auger bit and a grout pipe extending upwardly from the auger bit;

hoisting the auger on the mast with said hoisting cable;

providing the auger bit with a full displacement configuration including an upwardly-expanding, tapered stem and two-directional flighting with a lower flighting section oriented in a first direction and an upper flighting section oriented in a second direction;

providing said auger bit with a stem and and-wear protrusions comprising multiple, longitudinally-extending teeth formed alone said stem and extending between respective turns of said flighting and adapted for trapping soil on said stem;

providing the auger bit with a cutting tool at a lower end thereof and a grout discharge opening adjacent to the lower end thereof;

drilling a borehole with said auger and compacting the adjacent soil with said auger bit while rotating said auger in a first direction with said rig;

providing a source of cementous grout and connecting same to said rig mast;

pumping said grout through said grout pipe and said auger bit and out said discharge opening into said borehole;

substantially filling said borehole with said grout under pressure;

extracting said auger with said hoisting cable while rotating same with said rig in said first direction;

providing a reinforcing cage with lower and upper ends;

attaching said reinforcing cage upper end to said hoisting cable;

hoisting said reinforcing cage on said mast with said hoisting cable;

lowering said reinforcing cage into said grout-filled borehole with said listing cable; and retaining said reinforcing cage upper end in proximity to the ground surface; and curing said grout around said reinforcing cage.

16. The method according to claim 15, which includes the additional step of:

providing a cutting tool with a guide and a reamer extension adapted for cutting medium-to-hard clay and weathered shale.

17. The method according claim 15, which includes the additional step of:

providing a cutting tool with a fishtail pilot and teeth adapted for cutting loam and similar soils.

18. The method according claim 15, which includes the additional step of:

providing a cutting tool with a bullet tooth pilot and progressive bullet teeth.

19. A displacement-type auger bit for drilling a borehole, which bit comprises:

a stem with lower end upper sections and a longitudinally-extending, rotational axis;

said lower and upper sections terminating at lower and upper stem ends respectively;

a cutting tool mounted on said lower stem end and adapted for cutting through a subsurface material in connection with drilling a borehole;

said stem lower section having a downwardly-tapered configuration;

said stem upper section having an upwardly-tapered configuration;

a coupling mounted on said stem upper end and adapted for coupling to a grout pipe;

flighting including a flighting lower section mounted on said stem lower section and generally helical in a first direction and a flighting upper section mounted on said stem upper section and generally helical in the opposite direction;

a soil path generally defined by said stem and said flighting; and an anti-wear protrusion mounted on said flighting generally in said soil path and adapted for spacing soil from portions of said flighting, said anti-wear protrusion comprising a flighting block extending radially across substantially the entire width of said flighting and adapted for trapping soil on a respective face of said flighting.

20. A method of constructing a subsurface, cementous foundation pile, which comprises steps of:

providing an auger drilling rig including a mast and a hoisting cable on said mast;

rotatably mounting on the mast an auger including an auger bit and a grout pipe extending upwardly from the auger bit;

hoisting the auger on the mast with said hoisting cable;

providing the auger bit with a foil displacement configuration including an upwardly-expanding, tapered stem and two-directional flighting with a lower flighting section oriented in a first direction and an upper flighting section oriented in a second direction;

providing said auger bit with an anti-wear protrusion comprising flighting block extending radially across substantially the entire width of said flighting and adapted for trapping soil on a respective face of said flighting;

providing the auger hit with a cutting tool at a lower end thereof and a grout discharge opening adjacent to the lower end thereof;

drilling a borehole with said auger and compacting the adjacent soil with said auger bit while rotating said auger in a first direction with said rig;

providing a source of cementous grout and connecting same to said rig mast;

pumping said grout through said grout pipe and said auger bit and out said discharge opening into said borehole;

substantially filling said borehole with said grout under pressure;

extracting said auger with said hoisting cable while rotating same with said rig in said first direction;

providing a reinforcing cage with lower and upper ends;

attaching said reinforcing cage upper end to said hoisting cable;

hoisting said reinforcing cage on said mast with said hoisting cable;

lowering said reinforcing cage into said grout-filled borehole with said listing cable; and retaining said reinforcing cage upper end in proximity to the ground surface; and curing said grout around said reinforcing cage.

* * * * *